US009446892B2

(12) United States Patent
Piscopo et al.

(10) Patent No.: US 9,446,892 B2
(45) Date of Patent: Sep. 20, 2016

(54) PROTECTIVE ENCLOSURE FOR TRANSPORTING AN AUTOMOBILE DOOR

(71) Applicant: Impact Salvage Enhancement Solutions, Inc., Longwood, FL (US)

(72) Inventors: Gene Piscopo, Longwood, FL (US); Charlie Salter, Longwood, FL (US)

(73) Assignee: Impact Salvage Enhancement Solutions, Longwood, FL (US)

( * ) Notice: Subject to any disclaimer, the term of this patent is extended or adjusted under 35 U.S.C. 154(b) by 3 days.

(21) Appl. No.: 14/249,010

(22) Filed: Apr. 9, 2014

(65) Prior Publication Data

US 2015/0291334 A1 Oct. 15, 2015

(51) Int. Cl.

| | |
|---|---|
| ***B65D 81/05*** | (2006.01) |
| ***B65D 81/03*** | (2006.01) |
| ***B65D 65/10*** | (2006.01) |
| *B65D 81/02* | (2006.01) |
| *B65D 33/00* | (2006.01) |
| *B65D 85/68* | (2006.01) |

(52) U.S. Cl.

CPC ..... *B65D 81/03* (2013.01); *B65D 65/10* (2013.01); *B65D 81/055* (2013.01); *B65D 33/005* (2013.01); *B65D 81/022* (2013.01); *B65D 85/68* (2013.01); *B65D 2519/0084* (2013.01); *B65D 2519/00835* (2013.01); *B65D 2581/055* (2013.01); *B65D 2585/6887* (2013.01)

(58) Field of Classification Search

CPC ..... B65D 2585/68; B65D 2585/6875; B65D 2585/686; B65D 2585/6887; B65D 81/02; B65D 81/027; B65D 81/025; B65D 81/051; B65D 81/05; B65D 81/053–81/056; B65D 85/68; B65D 33/005; B65D 2519/00835; B65D 2519/0084; B65D 85/48; B65D 5/5026; B65D 5/5085

USPC ..... 294/150, 152, 165, 138, 141

See application file for complete search history.

(56) References Cited

U.S. PATENT DOCUMENTS

| | | | | |
|---|---|---|---|---|
| 4,601,390 | A * | 7/1986 | Rosenthal et al. | 206/175 |
| 5,031,733 | A * | 7/1991 | Chang | 190/1 |
| 5,175,041 | A * | 12/1992 | Webb | B65D 65/44 206/586 |
| 6,116,423 | A * | 9/2000 | Troxtell et al. | 206/523 |
| 8,459,710 | B1 * | 6/2013 | White | 294/152 |
| 8,474,614 | B2 * | 7/2013 | Hanson et al. | 206/320 |
| 2007/0034626 | A1 * | 2/2007 | Warren | A45C 7/0036 220/9.2 |
| 2011/0210024 | A1 * | 9/2011 | Tanaka et al. | 206/320 |
| 2013/0277418 | A1 * | 10/2013 | Van Berlo | B65D 5/5047 229/87.02 |
| 2016/0068332 | A1 * | 3/2016 | Flynn | B65D 85/38 206/451 |

FOREIGN PATENT DOCUMENTS

| | | | |
|---|---|---|---|
| CN | 203369514 U | * | 1/2014 |
| JP | 2003062917 A | * | 3/2003 |

* cited by examiner

*Primary Examiner* — Steven A. Reynolds
*Assistant Examiner* — Mollie Llewellyn
(74) *Attorney, Agent, or Firm* — Jason T. Daniel, Esq.; Daniel Law Offices, P.A.

(57) ABSTRACT

A protective enclosure for transporting an automobile door includes an elongated, generally U-shaped main body having a pair of opposing side panels connected along a bottom edge by a bottom panel. A plurality of padded elements are located along the inside facing surfaces of the main body, and multiple inelastic straps are located along the outside edges of the main body. The straps including connectors for selectively engaging each of the opposing side panels.

12 Claims, 3 Drawing Sheets

PROTECTIVE ENCLOSURE FOR TRANSPORTING AN AUTOMOBILE DOOR

TECHNICAL FIELD

The present invention relates generally to packaging and shipping containers, and more particularly to a protective enclosure for automobile doors which can prevent the doors from becoming damaged during shipping.

BACKGROUND

The statements in this section merely provide background information related to the present disclosure and may not constitute prior art.

Virtually any exterior portion of an automobile is subject to being damaged and requiring repair. In this regard, automobile bodies are constructed from a plurality of interior and exterior panels (e.g., quarter panels, door panels, hoods, trunks, etc.,) that may become damaged due to a vehicle collision, misuse, or vandalism, for example.

Although minor damage such as scrapes and nicks can typically be repaired in a cost effective manner, more significant damage such as cracks, bends, and structural issues typically necessitate that the panel be replaced. When this situation occurs, many vehicle owners choose to replace the damaged panel with a less expensive used panel which can be recycled from a salvage yard or other such provider.

Indeed, the automobile salvage industry is undergoing a boon by recycling quality undamaged automobile components to repair shops for a fraction of the cost of an equivalent OEM component. This is especially true for doors and door panels, which are most commonly replaced with recycled components. In this regard, when a salvage yard receives an order for a door or door panel, a worker will physically pull the door panel, and carry it to a transport area where the door will be wrapped with cardboard and transported to a courier for delivery to the repair shop.

Although the cardboard covering can prevent the surface of the door from being scratched, it provides no protection against damage caused from physical impacts with other objects, nor does it protect the door from becoming damaged if it is dropped by the courier. For these reasons, it is not uncommon for a repair shop to receive a recycled door that has dents and other imperfections. When this occurs, the repair shop must either return the damaged door, or spend precious time and resources to return the recycled door to a pristine condition.

Accordingly, the need exists for an automobile door enclosure which can function both as a convenient carrying case and as a protective barrier to protect the door from being damaged through contact with an external object.

SUMMARY OF THE INVENTION

The present invention is directed to a protective enclosure device for automobile doors. One embodiment of the present invention can include an elongated, generally U-shaped main body that is constructed from a semi-flexible that has an inside surface, an outside surface, and an inertia damper middle layer.

The device can include multiple padded elements along the inside facing surface, and a non-skid bottom coating. Multiple inelastic straps can secure the sides of the device together, in order to securely engage and encompass a door located within the device. Additionally, any number of handles can also be provided to facilitate easy transport of the device.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1A:
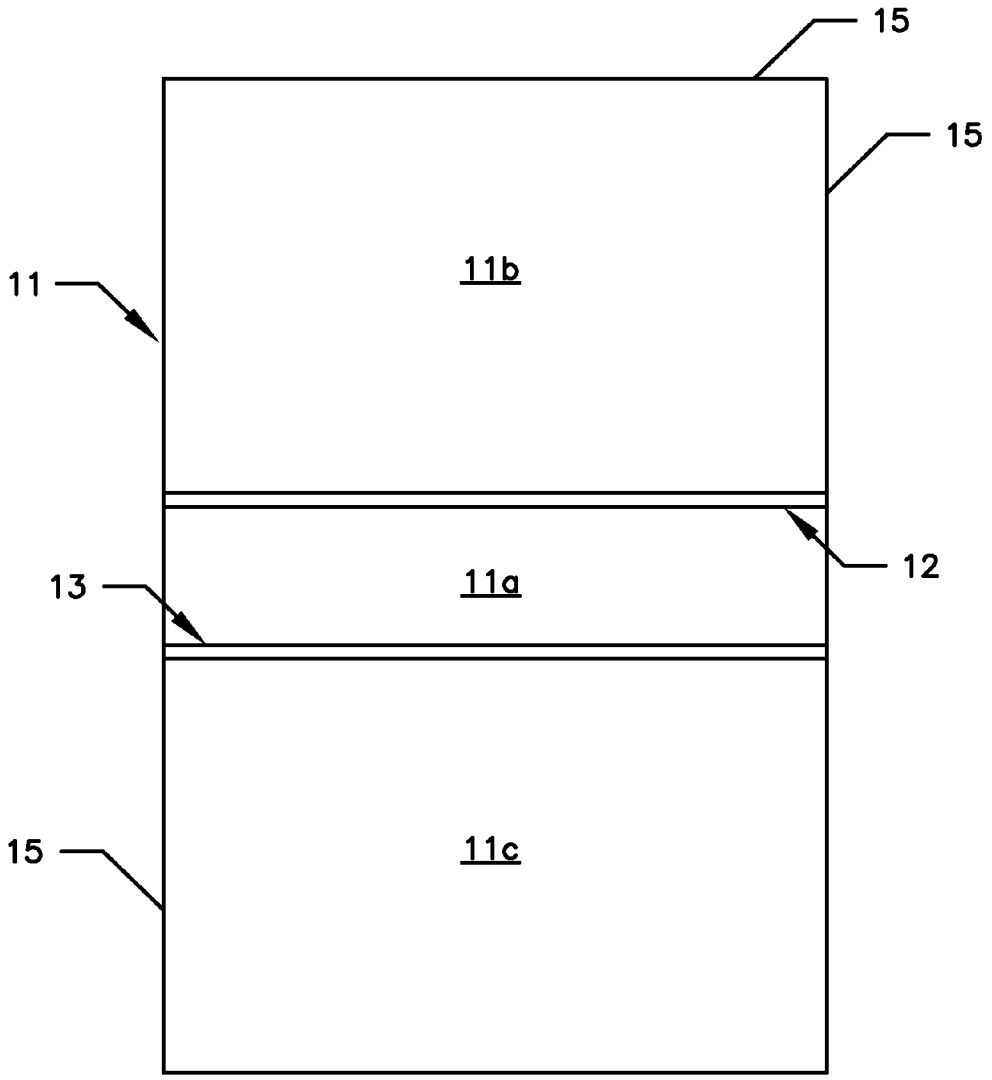
FIG. 1A illustrates one embodiment of the main body of a protective enclosure for transporting an automobile door that is useful for understanding the embodiments disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "length," "width," "depth," "upper," "bottom," "right," "left," "front," "vertical," "horizontal," and derivatives thereof shall relate to the invention as oriented in FIG. 2. Although described below with respect to an enclosure for transporting automobile doors, the inventive concepts disclosed herein are not to be construed as limiting to a door or door panel. As such, other embodiments of the protective enclosure are contemplated, and can include any number of different shapes and dimensions, suitable for protecting virtually any automobile component such as hoods, body panels, trunk lids, interior components and the like, without undue experimentation.

As described below with respect to FIGS. 1-4, a protective enclosure for transporting an automobile door 10 (i.e., device) can function as both a convenient carrying case for a salvage yard and/or parts warehouse, as well as an enclosure for protecting a recycled door from becoming damaged due to unintentional impacts with foreign objects.

Figure 1B:
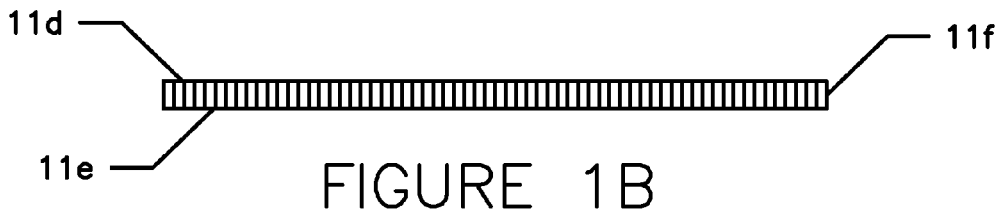
FIG. 1B is a cutout side view of the main body of the protective enclosure for transporting an automobile door of FIG. 1.

As shown in FIGS. 1A and 1B, one embodiment of the protective enclosure 10 can include an elongated, generally rectangular member 11 which can be shaped to include a bottom panel 11*a* that is interposed between a pair of opposing side panels 11*b* and 11*c* via bends and/or living hinges 12 and 13, respectively. In the preferred embodiment, the main body 11 can be constructed from a single sheet of semi-flexible material having an inside facing surface 11*d*, an outside facing surface 11*e* and an inertia damper layer 11*f* interposed therebetween.

One suitable material includes one or more sheets of corrugated plastic having a plurality of in-line and/or honeycomb corrugations (i.e., inertia dampers 11*f*) interposed between a first surface (i.e., 11*d*) and a second surface (i.e., 11*e*). Such a material resulting in an extremely lightweight product that is capable of absorbing impacts with foreign objects owing to the inherent damping qualities of the corrugations 11*f*.

In the preferred embodiment, plastic edging 15 can be permanently affixed around the outer edge surfaces of the main body. Edging 15 can function to completely cover the corrugations 11*f* located along the outside edges of the main body, and also to prevent the main body material from ripping and/or to prevent separation of the main body layers 11*d*, 11*e* and 11*f*.

Figure 2:
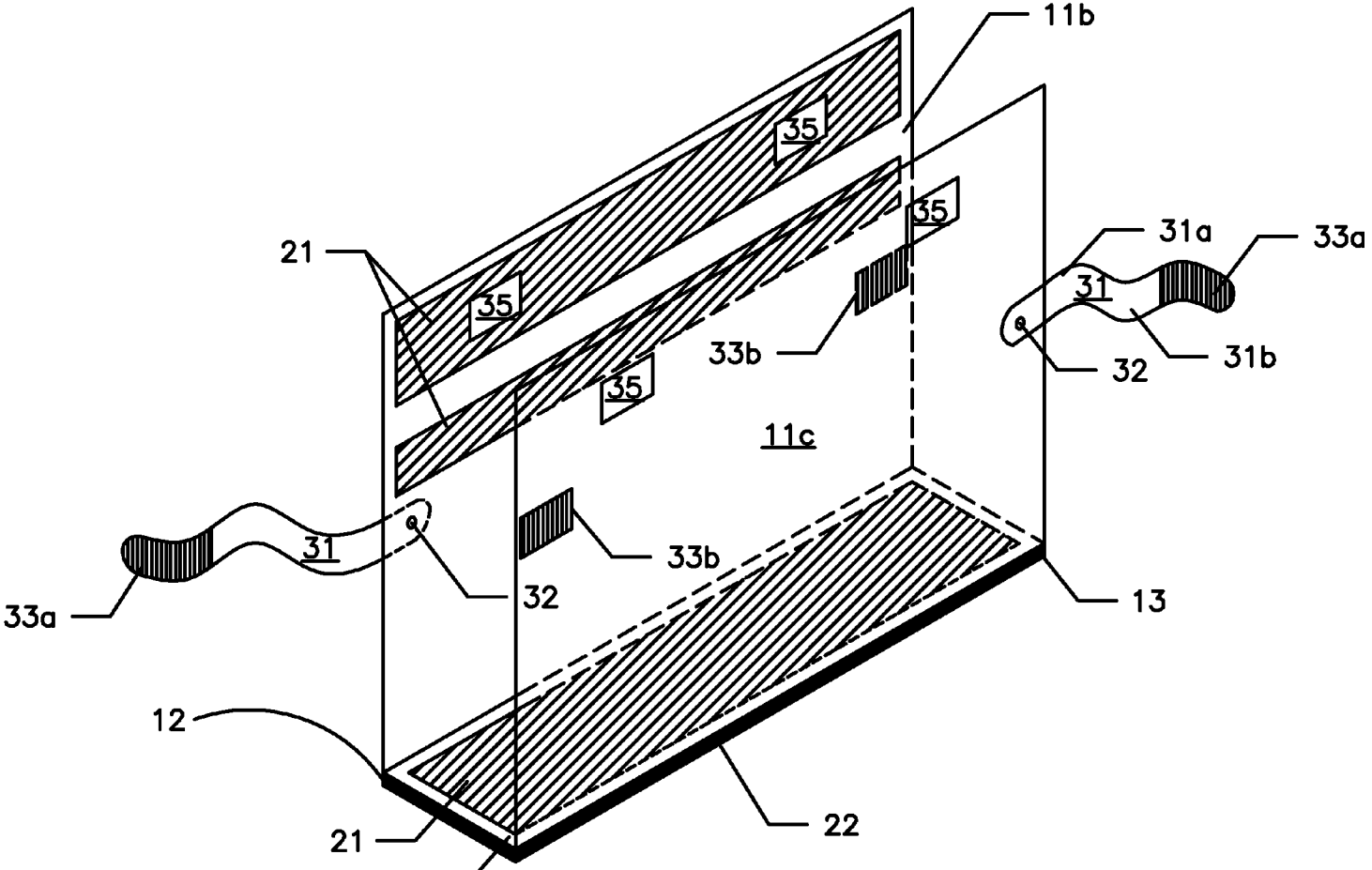
FIG. 2 is a perspective view of the protective enclosure for transporting an automobile door, in accordance with one embodiment of the invention.

FIG. 2 illustrates one embodiment of the protective enclosure in an assembled and open configuration. As shown, the opposing side panels 11*b* and 11*c* can each bend approximately 90 degrees along folds 12 and 13, with respect to the bottom panel 11*a*. At this time, the main body can be formed into an elongated, generally U-shaped configuration, wherein side panels 11*b* and 11*c* are aligned parallel to one another. While the dimensions of the elements are not critical, in the preferred embodiment the enclosure 10 can include a length (i.e., distance from the left edge of the main body to the right edge of the main body as shown in FIG. 2) of approximately 46 inches, a width (i.e., distance between panels 11*b* and 11*c* along the bottom panel 11*a*) of approximately 6 inches, and a height (i.e., vertical distance between the top edge of the panels 11*b* and 11*c* from the bottom panel 11*a*) of approximately 30 inches. Such dimensions being suitable for receiving and securing automobile doors and door panels for nearly any passenger or commercial vehicle. Of course, any number of other shapes and dimensions are also contemplated.

As shown, several padded elements and/or elongated strips of padding 21, can be disposed along the inside facing surface of one or more of the panels 11*a*, 11*b* and 11*c*. The padding 21 can preferably be constructed from a lightweight impact resistant and/or impact cushioning material, such as Styrofoam, high density foam, high resilience foam, Polyurethane, memory foam, closed cell foam, and open cell foam, for example. The padding 21 can be secured onto the panels in accordance with known construction methodologies such as adhesives or double sided tape, among others, for example.

A skid plate 22 can be disposed along the outside facing surface of the bottom panel 11*a*. The skid plate 22 can preferably be constructed from a lightweight material such as plastic or rubber, for example, that has a high coefficient of friction when in contact with surfaces such as wood, plastic, concrete and metal, for example, in order to prevent the device from sliding along a floor and/or falling over when in use. Of course, any number of other suitable materials can be utilized herein. The skid plate 22 can also be secured onto the panel in accordance with known construction methodologies such as adhesives or double sided tape.

The device 10 can also include one or more inelastic nylon straps 31 having a first end 31*a* that is glued, riveted or otherwise permanently affixed 32 to one of the side panels 11*b* and 11*c*, and a second end 31*b* that includes a connector 33*a*. Connector 33*a* being positioned so as to engage a complementary connector 33*b* which is located on the panel 11*b* and/or 11*c*. Several examples of suitable connectors include opposing strips of hook and loop material and/or compression fittings such as snaps, buttons and the like.

The protective enclosure 10 can also include a plurality of carrying handles 35 which can preferably be formed by the absence of material along one or more of the panels 11*a*, 11*b*, and 11*c*. Although not illustrated, each of the handles 35, can also be lined with the plastic edging, in order to increase the comfort to a user carrying the device. Of course, any number of other handles and/or carrying members can be secured along the main body at virtually any desirable location.

Although described above as utilizing particular materials, and/or construction methodologies, this is for illustrative purposes only. To this end, those of skill in the art will recognize that each component of the protective enclosure can be constructed from any number of different materials suitable for carrying out the functionality described herein, and can be manufactured in accordance with any number of conventional manufacturing methodologies. Moreover, as described herein, the term "removably secured" describes a situation wherein two or more objects are joined together in a non-permanent manner so as to allow the same objects to be repeatedly joined and separated.

Figure 3:
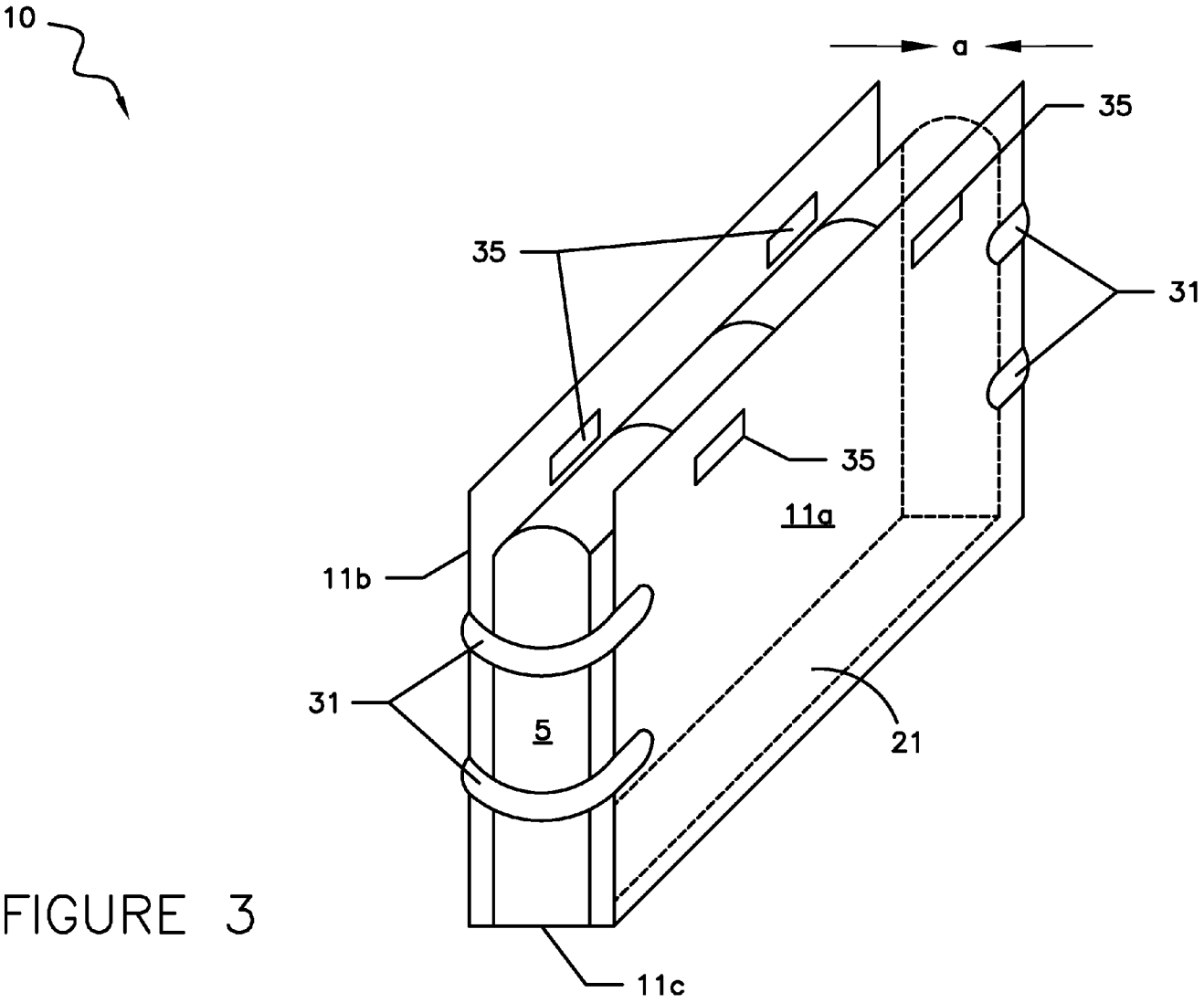
FIG. 3 is a perspective view of the protective enclosure for transporting an automobile door in operation, and in accordance with one embodiment of the invention.

FIG. 3 illustrates one embodiment of the protective enclosure 10 in operation, and in a closed configuration. As shown, once a door 5 is positioned onto the bottom panel 11*a*, the upper ends of the side walls 11*b* and 11*c* can bend inward, (see arrows a), until the padding 21 is in contact with the door. At this time, the strap(s) 31 and connectors 33*a* and 33*b* can be engaged, thereby securing the door within the confines of the main body in a manner that prevents the door from moving and/or becoming dislodged from the enclosure.

Once positioned within the enclosure, a user can easily lift and transport the device using the handles 35. During this time, should the enclosure 10 be dropped, or come into contact with foreign objects, the panels 11*a*, 11*b* and 11*c*, along with the padding 21 will function to protect the door 5 from becoming damaged.

As described herein, one or more elements of the protective enclosure for an automobile door 10 can be secured together utilizing any number of known attachment means such as, for example, screws, glue, compression fittings and welds, among others. Moreover, although the above embodiments have been described as including a main body 11 having unitary construction from a single material, the inventive concepts disclosed herein are not so limiting. To this end, one of skill in the art will recognize that the main body panels 11*a*, 11*b*, and 11*c*, can be constructed from individual and separate elements that are joined together via physical hinges 12 and 13, with the aforementioned components forming identifiable sections thereof. As described above, when the straps are not engaged with each of the opposing side panels, the device is said to be in an open configuration, and when the straps are engaged with each of the opposing side panels, the device is in a closed configuration.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A protective enclosure device for automobile doors, said device comprising:

an elongated main body that is constructed from a single sheet of corrugated plastic, and consisting of:

a first side panel having a top edge and a bottom edge, a second side panel having a top edge and a bottom edge, a bottom panel having a planar top surface, a planar bottom surface, a first edge and a second edge, said first edge including a length that is identical to a length of the bottom edge of the first side panel, and said second edge including a length that is identical to a length of the bottom edge of the second side panel, a first living hinge that is interposed along an entirety of the bottom edge of the first side panel and the first edge of the bottom panel, and a second living hinge that is interposed along an entirety of the bottom edge of the second side panel and the second edge of the bottom panel, said first and second living hinges functioning to transition the main body between a flat orientation and a generally U-shaped orientation, an inertia damper layer that is interposed between an inside facing surface and an outside facing surface of each of the first side panel, the second side panel, and the bottom panel of the main body;

the protective enclosure further comprising a plurality of padding elements that are disposed along an entirety of the inside facing surface of the bottom panel, and along portions of at least one of the inside facing surface of the first and second side panels;

at least one inelastic strap having a first end that is permanently secured to one of the first and second side panels, and a second end that is removably secured to the other of the first and second side panels;

at least one carrying handle that is disposed along one of the first and second side panels; and an anti-skid plate that is permanently secured along the outside facing surface of the bottom panel.

2. The device of claim 1, wherein said anti-skid plate includes at least one of rubber and plastic having a high coefficient of friction when contacting an external surface.

3. The device of claim 1, wherein the first end of the at least one inelastic strap is secured to one of the first and second side panels via at least one of a rivet and a permanent adhesive.

4. The device of claim 1, wherein the second end of the at least one inelastic strap is secured to one of the first and second side panels via strips of hook and loop material.

5. The device of claim 1, wherein the at least one elongated strap consists of:

four elongated straps, each having a first end that is permanently secured to one of the first and second side panels via at least one of a rivet and a permanent adhesive, and a second end that is removably secured to the other of the first and second side panels via strips of hook and loop material.

6. The device of claim 1, wherein each of the at least one handle consists of an opening that is disposed along one of the first and second panels, and said opening further including a plastic edging located along an outer periphery thereof.

7. The device of claim 1, wherein the main body has a length of approximately 46 inches, a width of approximately 6 inches, and a height of approximately 30 inches.

8. The device of claim 1, wherein said padding elements include elongated strips of soft impact resistant material.

9. The device of claim 8, wherein said impact resistant material includes at least one of styrofoam, high density foam, high resilience foam, polyurethane, memory foam, closed cell foam, and open cell foam.

10. The device of claim 1, further comprising:

plastic edging that is disposed along an outer edge of each of the bottom panel, the first panel and the second panel.

11. The device of claim 1, wherein the inertia damper layer consists of:

a plurality of honeycomb corrugations that are configured to absorb an impact with a foreign object.

12. A protective enclosure device for automobile doors, said device consisting of:

an elongated main body that is constructed from a single sheet of corrugated plastic having a first side panel having a top edge and a bottom edge, a second side panel having a top edge and a bottom edge, a bottom panel having a planar top surface, a planar bottom surface, a first edge and a second edge, said first edge including a length that is identical to a length of the bottom edge of the first side panel, and said second edge including a length that is identical to a length of the bottom edge of the second side panel, a first living hinge that is interposed along an entirety of the bottom edge of the first side panel and the first edge of the bottom panel, and a second living hinge that is interposed along an entirety of the bottom edge of the second side panel and the second edge of the bottom panel, said first and second living hinges functioning to transition the main body between a flat orientation and a generally U-shaped orientation, said main body including a dimension in the generally U-shaped orientation that is complementary to a dimension of an automobile door and consists of a length of 46 inches, a width of 6 inches, and a height of 30 inches;

an inertia damper layer that is interposed between an inside facing surface and an outside facing surface of each of the first side panel, the second side panel, and the bottom panel of the main body;

a plurality of padding elements that are disposed along an entirety of the inside facing surface of the bottom panel, and along portions of at least one of the inside facing surface of the first and second side panels;

at least one inelastic strap having a first end that is permanently secured to one of the first and second side panels, and a second end that is removably secured to the other of the first and second side panels;

at least one carrying handle that is disposed along one of the first and second side panels; and an anti-skid plate that is permanently secured along the outside facing surface of the bottom panel.

* * * * *